US005226710A

United States Patent [19]

Giglia et al.

[11] Patent Number: 5,226,710

[45] Date of Patent: Jul. 13, 1993

[54] VENTED, FLEXIBLE, THIN CHEMILUMINESCENT DEVICE

[75] Inventors: Robert D. Giglia, Rye, N.Y.; William E. Bay, Martinez, Calif.; Kevin Nolan, Bridgeport, Conn.

[73] Assignee: American Cyanamid Company, Stamford, Conn.

[21] Appl. No.: 922,432

[22] Filed: Jul. 30, 1992

[51] Int. Cl.[5] ..... F21K 2/06

[52] U.S. Cl. ..... 362/34; 362/84

[58] Field of Search ..... 362/34, 84

[56] References Cited

U.S. PATENT DOCUMENTS

| | | | |
|---|---|---|---|
| 3,500,033 | 3/1970 | Cole, Jr. et al. | 362/34 |
| 3,539,794 | 11/1970 | Rauhut et al. | 362/34 |
| 3,729,425 | 4/1973 | Heller et al. | 252/700 |
| 3,749,620 | 7/1973 | Montgomery | 156/73.1 |
| 3,751,846 | 8/1973 | Benjamin, Sr. | 362/34 |
| 3,781,536 | 12/1973 | Naeseth et al. | 362/34 |
| 3,808,414 | 4/1974 | Roberts | 362/34 |
| 3,893,938 | 7/1975 | Rauhut | 252/700 |
| 4,384,589 | 5/1983 | Morris | 401/199 |
| 4,635,166 | 1/1987 | Cameron | 362/34 |
| 4,814,949 | 3/1989 | Elliott | 362/34 |

*Primary Examiner*—Ira S. Lazarus
*Assistant Examiner*—L. Heyman
*Attorney, Agent, or Firm*—Frank M. Van Riet

[57] ABSTRACT

There is provided a flexible, thin, chemiluminescent device comprised of a back sheet having sealed thereto at its edges a windowed front sheet, separation means to divide the internal cavity into a larger and a smaller compartment, the larger compartment containing a contents-releasable receptacle for one part of a two-part chemiluminescent composition and an absorbent material in the larger compartment containing the second part of the composition external to the receptacle, the smaller compartment forming an exit passageway for gases, being in open communication with the larger compartment at its upstream end, and open to the atmosphere through a vent at its downstream end, whereby gases generated during storage and use can exit harmlessly without distorting or inflating the device. The smaller compartment may contain a gas porous component which acts to separate residual liquid from escaping gas thereby preventing unwanted liquid leakage from the chemiluminescent device.

8 Claims, 2 Drawing Sheets

FIG. 1
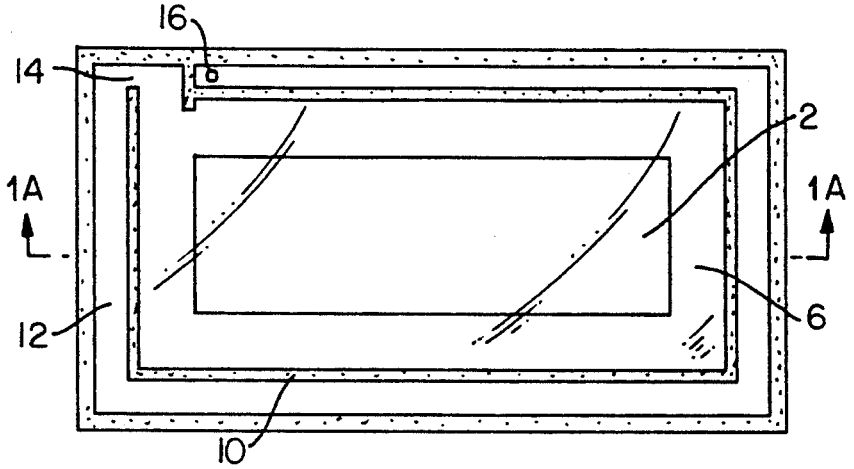
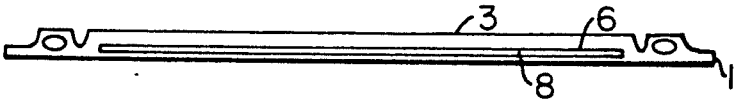
FIG. 1A
FIG. 2A
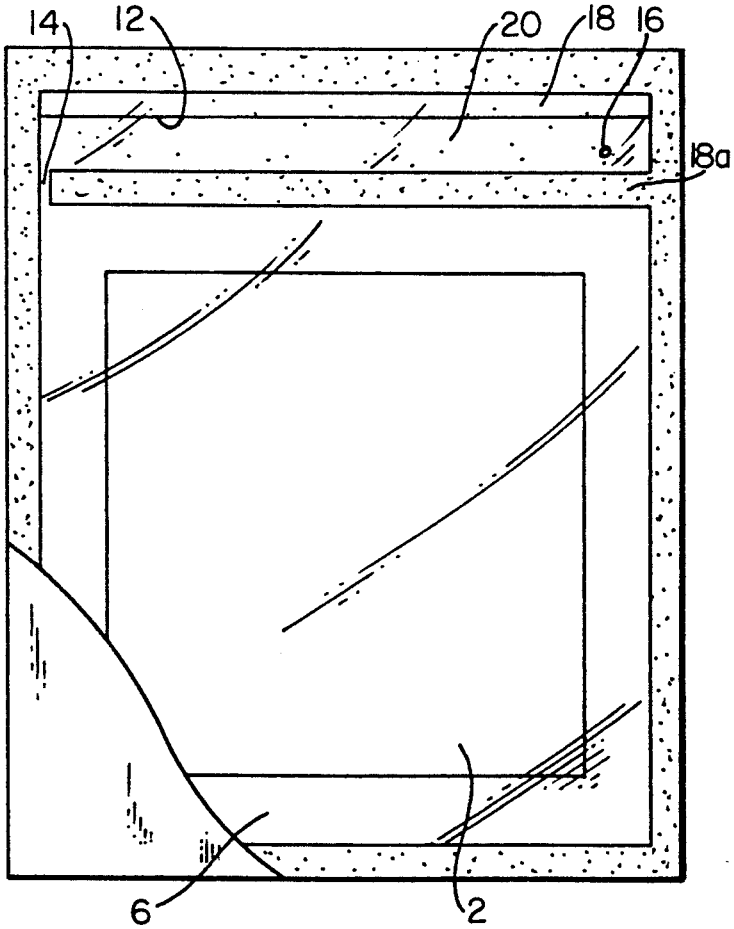
FIG. 2B
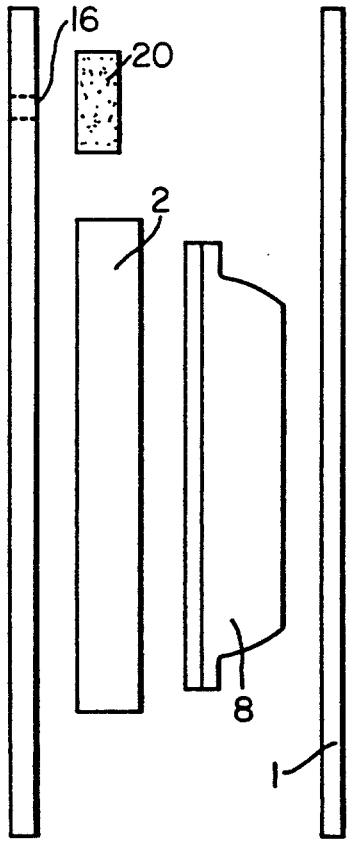

VENTED, FLEXIBLE, THIN CHEMILUMINESCENT DEVICE

BACKGROUND OF THE INVENTION

The production of devices capable of emitting light through chemical means is well known in the art. Lightsticks, for example, are taught in U.S. Pat. No. 3,539,794 while other configurations have also been the subject of many U.S. Pat. Nos. e.g. 3,749,620; 3,808,414; 3,893,938. Additional recent patents include U.S. Pat. No. 4,635,166 and U.S. Pat. No. 4,814,949.

The device shown in FIG. 2 of U.S. Pat. No. 4,814,949 is one over which the devices of the present invention are an improvement. Such a device comprises a first polymeric sheet having a shaped cavity therein, sealed around its periphery to a second polymeric sheet and the cavity contains (1) an absorbent article produced from a polyolefin, or a polyester or glass fibers and being of substantially the same shape as the cavity and (2) a sealed receptacle containing a first liquid component of a chemiluminescent light composition and wherein there is also present, outside said sealed receptacle, a second liquid component of a chemiluminescent light composition, said absorbent article conforming to several preferred features. The devices of this type have achieved widespread commercial acceptance, but they have one drawback, and that is a tendency to distort or inflate during storage and/or use because they are totally sealed and gas-tight.

The present invention provides improved low profile (flat), flexible devices of the above-mentioned, totally-sealed type in which a liquid component is substantially immobilized within the internal cavity. Even though gases are generated during storage or use there is no longer observed unwanted distortion or inflation because a novel venting means is now provided in the form of an annular passage formed adjacent to the peripheral seal of the device. One end of the annular passage is open to the atmosphere. The annular passage may be empty or contain a means to entrap residual liquid while it allows gases to pass freely through to the atmosphere. A preferred embodiment of the invention comprises an oliophobic material within the annular passage in the form of a porous foam (open cell) or fibrous structure. The invention has particular utility in chemical light producing devices which are assembled with liquid chemicals premixed at temperatures below ambient so as to slow or stop the light producing reaction. The light producing chemicals may be absorbed in fibrous or foam pad structures. Such devices may be stored at suitable low temperatures until use later when exposure to ambient temperature warming causes the reaction to begin and generate light. Another embodiment useful to chemical light devices is to add an adhesive tab or overlay seal over the vent hole to atmosphere during storage so as to protect against unwanted gas or vapor from the atmosphere reacting with chemical components within the device. The overlay or adhesive seal may be removed during operation of the device to eliminate the restriction to gas flow.

SUMMARY OF THE INVENTION

The present invention relates to a flexible, thin, chemiluminescent device comprised of (i) a back sheet, e.g., of a polymer or a polymer-laminated metal foil;

(ii) a front sheet comprising a transparent or translucent polymer sealed at its edges to the back sheet to provide a fluid-tight internal compartment or cavity for a two-component chemiluminescent system;

(iii) separation means positioned so as to divide the internal cavity of the device into two compartments, one larger and one smaller;

(iv) a contents-releasable, fluid-tight receptacle containing a solvent solution of a first chemical component within the larger compartment;

(v) an absorbent material containing a solvent solution of a second chemical component within the larger compartment but external to the receptacle;

(vi) an open passageway between the larger and the smaller compartments; and (vii) a vent in the wall of the smaller compartment and located downstream from the passageway, whereby deformation of the larger compartment causes release of the contents of the receptacle and mixes the chemical components for absorption by the liquid-absorbent material therein to react and produce light, any gases generated during storage or the light-producing reaction passing into the smaller compartment and being substantially released therefrom through the vent instead of distorting or inflating the device; and, preferably, (viii) an oliophobic, porous component in the smaller compartment acting to separate residual liquid from escaping gases so as to eliminate liquid leakage from the device. This porous component may be sealed to the edges of the smaller compartment to prevent gas bypass of the porous component surfaces.

BRIEF DESCRIPTION OF THE DRAWINGS

The invention may better be understood by reference to the drawings in which:

FIG. 1 depicts a front sectional view of a chemiluminescent device in the shape of a thin, flexible rectangle.

FIG. 1A depicts a cross-sectional view of the device of FIG. 1 taken along line 1A—1A thereof.

FIG. 2A depicts a front sectional view of a preferred chemiluminescent device of the invention in which the vented passage is shorter and filled with an open-celled polymeric foam.

FIG. 2B is an exploded view of the device of FIG. 2A showing the pre-assembled components thereof.

DETAILED DESCRIPTION OF THE DRAWINGS

Figure 3A:
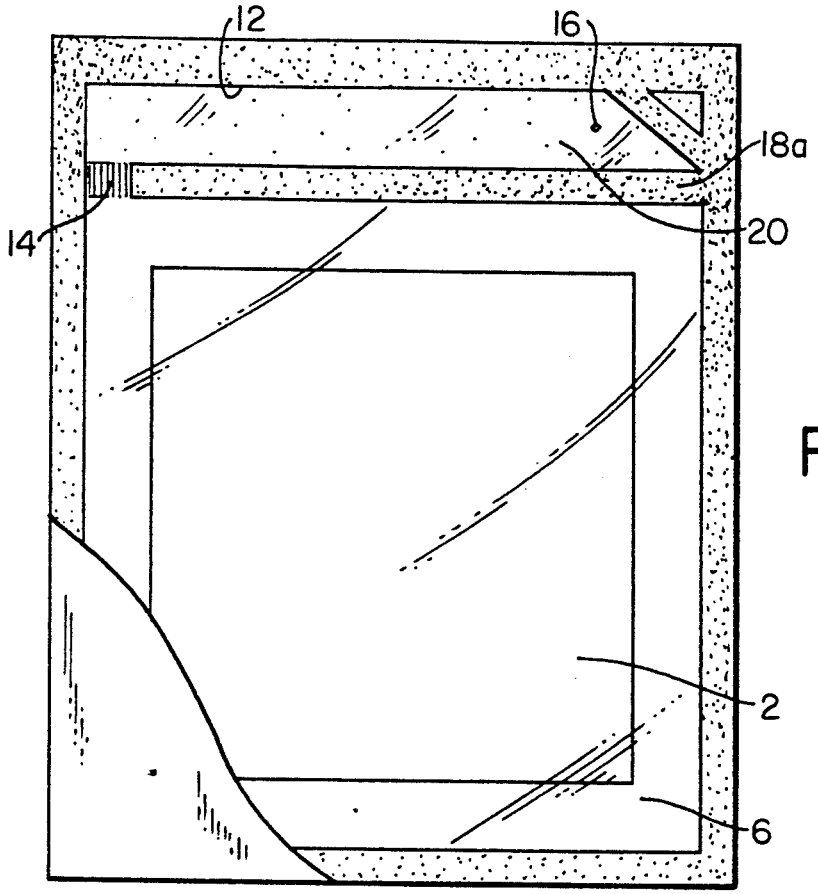
FIG. 3A depicts a top sectional view of another preferred chemiluminescent device of the invention in which the open celled pad material in the vent passage is sealed integrally with the laminated structure.

Referring to FIGS. 1 and 1A, the chemiluminescent device comprise a first (back) polymeric sheet 1 having an open liquid- or pad-receiving compartment area in the form of rectangle 6, of substantially the same size or larger than that desired for the light emitting window in cover sheet 3. A light pad 2 is located in the rectangle 6. It can have absorbed thereon a quantity of a component of a chemiluminescent light composition. If both components are absorbed and kept cold, no light will be generated until the device is warmed to ambient temperature. Alternatively, one component of the chemiluminescent composition can be absorbed or contained in the rectangular compartment area 6 and an optional, sealed, contents-releasable receptacle 8, such as a plastic pouch or a glass ampule, containing a quantity of another component of the chemiluminescent light composition can be included to release the reactant for mixing and light emission. A second polymeric sheet 3 comprises the topmost surface of the device, sheets 1 and 3 being sealed together around the outer periphery of the device. Inboard of the outer seal is provided a relatively long inner seal 10 which forms an annular vent passage 12, open at its upstream end to the inner compartment through internal passageway 14, and to the atmosphere at its downstream end at vent 16. It is through this passageway that any gases generated during storage or use of the device exit harmlessly without excessively distorting or inflating the device.

FIG. 2A is a view of a preferred device in which vent 16 is located in vent passage 12 and passageway 14 is seen to provide open communication to the interior compartment 6. In this embodiment, seals 18 and **18*a* define the vent passage 12 and it is filled with an oliophobic open-celled foam 20 to minimize movement of any liquid from the inner compartment 6 to the vent 16** and thereafter to the atmosphere. The surface energy of the oliophobic material is preferably lower than the surface tension of the liquid.

The individual components of the device of FIG. 2A are shown in an exploded view in FIG. 2B, shaped article 2 substantially conforming in shape to the compartment formed from sheet 1 and 3 and receptacle 8 containing part of the chemiluminescent composition.

Figure 3B:
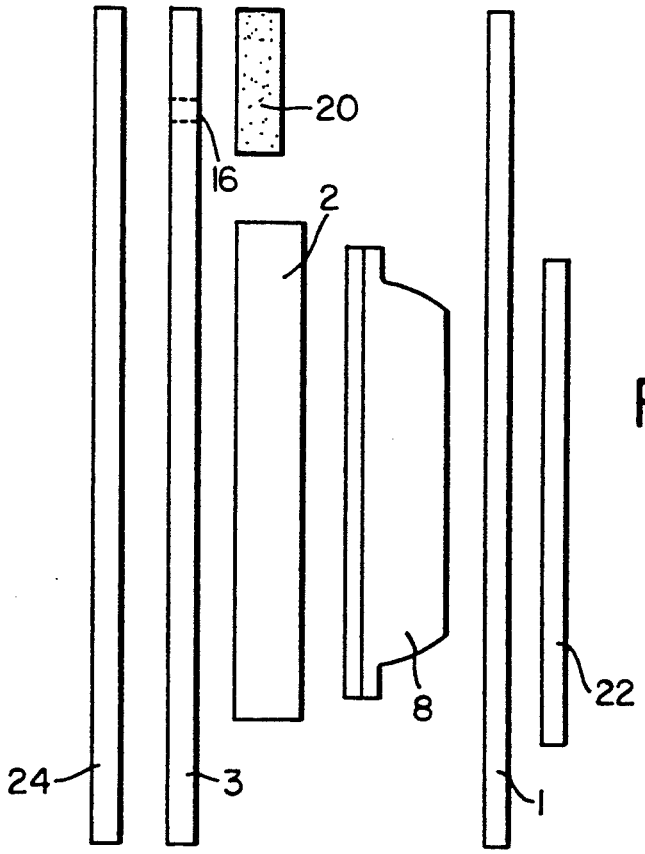
FIG. 3B is an exploded view of the device of FIG. 3A showing the pre-assembled components thereof, and includes a peelable overlay and a pressure sensitive adhesive label.

FIGS. 3A and 3B depict variations of the chemiluminescent devices of the present invention wherein only one internal seal **18*a* is used to form the vent passage and the foam 20 is extended into the seal zones, providing added assurance by avoiding a path of leakage past the oliophobic material, a pressure sensitive adhesive 22 is provided to facilitate mounting of the device on a fixed article, and a peelable front overlay 24 is used to protect the surface of the polymer window and the vent 16** during storage.

DETAILED DESCRIPTION OF THE INVENTION INCLUDING PREFERRED EMBODIMENTS

The instant invention is directed to a chemliluminescent device comprising, in sequential relationship, (i) a back sheet, preferably of a laminated metal foil;

(ii) a front sheet comprising a transparent or translucent polymer heat sealed at its edges to the back sheet to provide a fluid-tight internal cavity for a two-component chemiluminescent system;

(iii) separation means positioned so as to divide the internal cavity of the device into two compartments, one larger and one smaller;

(iv) a contents-releasable, fluid-tight receptacle containing a solvent solution of a first chemical component within the larger compartment;

(v) an absorbent material containing a solvent solution of a second chemical component within the larger compartment but external to the receptacle;

(vi) an open passageway between the larger and the smaller compartments; and (vii) a vent in the wall of the smaller compartment and located downstream from the passageway, whereby deformation of the larger compartment releases the contents of the receptacle and mixes the chemical components for absorption by the liquid-absorbent material therein to react and produce light, any gases generated during storage or the light-producing reaction passing into the smaller compartment and being released therefrom through the vent instead of substantially distorting or inflating the device.

Considering the elements of the device of the instant invention in the sequence presented above, the back sheet may be a sheet of plastic, but is preferably a laminated metal foil, preferably of aluminum, which is comprised of, in superimposed relationship, 1) aluminum foil of from about 0.0001 to about 0.002 inch in thickness and 2) low to medium density polyethylene or linear low to medium density polyethylene of from about 0.0005 to about 0.005 inch in thickness. In preferred embodiments, the low density polyethylene is adhered to the inside of the aluminum foil with an acrylic acid copolymer adhesive.

The resultant aluminum foil laminate imparts to the device of the instant invention: A) low or no permeability of volatile components of the activator solution, B) heat stability, C) no degradation, D) no delamination between the back sheet and the front sheet, E) nondeteriorating heat sealability, F) stability of chemiluminescent components and G) shelf life. Additionally, the laminate is receptive to self-adhering adhesives.

The total thickness of the aluminum foil laminate ranges from about 0.001 to about 0.01 inch.

The acrylic acid copolymer adhesive is known and generally comprises a copolymer with ethylene. The adhesive contains up to about 10%, by weight, of acrylic acid. A useful adhesive is sold by Dow Chemical Company under the tradename Primacor®. The laminate foil can be prepared by extrusion of a hot layer of the adhesive between the laminate layers, 1) or 2), or extrusion of the adhesive onto the foil followed by extrusion of the layer 2) onto the adhesive coated foil or by mixing the acrylic acid copolymer adhesive and the layer 3) in molten form and applying the mixture to the foil uniformly over its surface.

The side of the foil opposite that having the polyethylene thereon may contain a strength-imparting coating thereon such as oriented polyethylene, nylon etc. or may be decorated, printed on, etc.

The front sheet is generally coextensive with the first and comprises a polymeric flexible, transparent or translucent and chemically inert polymer. It has a shape retaining memory and toughness which resists bursting from internal or external pressure and discourages puncture. It is produced from a polyolefin, preferably polyethylene, polypropylene, or copolymers thereof and can range from about 0.001 to about 0.050 inch in thickness, preferably from about 0.002 to about 0.040 inch.

The non-woven, liquid-absorbent article is shaped to match the contour of the compartment or cavity formed between the foil and the front sheet. It is preferably die cut. The specific thickness, density etc. of the article is governed primarily by the volume of the chemiluminescent composition employed. The article is chemically inert and may be somewhat compressible. The article may be made from a polyolefin or a polyester or glass fibers. The polyolefin may be polyethylene, polypropylene etc., preferably polyethylene, which is formed into a nonwoven mat by compression or is formed into a porous condition such as is taught in U.S. Pat. Nos. 3,729,425 or 4,384,589. The porous polyethylenes are sintered, porous systems having a controlled porosity and having omni-directional, interconnecting pores. These products are available under the trade designation "POREX"® porous plastics and "Porous Poly"® from Porex Technologies Corp. Fairlawn, N.J. In general, the pore size may vary from 1 to 200 microns, preferably 10–50 microns.

The polyester may be, for example, polyethylene glycol terephthalate, the preferred polyester, polybutylene glycol terephthalate; poly 1,4-cyclohexanedimethanol terephthalate and the like, and may be formed into the non-woven article, for example, by compacting fibers thereof as is known in the art. The glass fibers may be manufactured into the desired non-woven structure also as is known in the art. These non-woven glass structures are commercially produced by Whatman, Inc. of Clifton, N.J,. and Gelman Sciences, Inc., Ann Arbor, Mich. and are preferably employed in the novel devices of the present invention in those instances where a high volume of light is desired over a short period of time.

A most preferred material is that disclosed and claimed in copending application, Ser. No. 07/632,844, filed Dec. 24, 1990, incorporated herein by reference. The most preferred material is a porous, flexible, plasticized structure comprising A) a non-particulate phase comprising a vinyl halide or vinylidene halide polymer having a molecular weight of about 100,000 to about 500,000 which constitutes about 0.5 to about 15.0 weight percent of the structure, B) an agglomerated particle phase comprising either 1) about 85.0 to about 99.5 weight percent of vinyl halide or vinylidene halide polymer particles having a diameter of from about 25 to about 125 microns and a molecular weight of from about 50,000 to about 120,000, or mixtures of said particles, or 2) about 45 to about 98.5 weight percent of vinyl halide or vinylidene halide polymer particles having a diameter of from about 25 to about 125 microns and a molecular weight of from about 50,000 to about 120,000, or mixtures of said particles and about 1 to about 40 weight percent of vinyl halide or vinylidene halide polymer particles having a diameter of from about 130 to about 225 microns and a molecular weight of from about 100,000 to about 225,000 and C) a plasticizer comprising a solvent solution of a chemiluminescent compound and, optionally, a fluorescer, dispersed throughout both said phases.

The vinyl halide or vinylidene halide polymers useful in the production of these structures are well known in the art. They include polyvinyl halides such as polyvinyl chloride and polyvinyl fluoride; polyvinylidene halides such as polyvinylidene chloride and polyvinylidene fluoride; copolymers of vinyl halides and/or vinylidene halides with hydrocarbons such as ethylene, propylene etc. in amounts of up to about 25%, by weight, based on the total weight of polymer preferably 5–15%, by weight, same basis; copolymers of vinyl halides such as vinyl chloride/vinyl fluoride copolymers; copolymers of vinylidene halides such as vinylidene chloride and vinylidene fluoride; copolymers of vinyl halides and vinylidene halides such as vinyl chloride and vinylidene chloride; terpolymers of vinyl halides and vinylidene halides such as terpolymers of vinyl chloride, vinyl fluoride and vinylidene chloride; mixtures of the above vinyl halide polymers and vinylidene halide polymers; mixtures of vinyl halide or vinylidene halide polymers and hydrocarbon polymers such as polyvinyl chloride and polyethylene in amounts up to about 25%, by weight, based on the total weight of polymers, of hydrocarbon polymer, preferably about 5–15%, be weight, same basis.

Homopolymers and copolymers of vinyl chloride are preferred.

Useful plasticizer solvents are selected from dialkyl esters of phthalic acid, ethylene glycol ethers, citric acid esters or alkyl benzoates such as ethyl benzoate, butyl benzoate etc. and are present in amounts of from about 0.5 parts to about 3.0 parts of plasticizer per part of vinyl halide or vinylidene halide polymer. A preferred plasticizer solvent is dibutyl phthalate and it is preferably used in a ratio of about 1.4 part to about 1.0 part of polymer.

The contents-releasable receptacle contains the first liquid component of the chemiluminescent light composition. The receptacle is preferably composed of a pouch, e.g., a plastic pouch. It can also be made of glass, i.e., it may comprise a glass ampoule. The main function of the receptacle is to segregate the chemiluminescent liquid contents therein from the second chemiluminescent liquid component; however, protection of the contained component from moisture, oxygen etc., and/or actinic light is also a favorable effect thereof. A preferred pouch is made from a heat-sealable polyethylene/foil/polypropylene/polyethylene film laminate. It is chemically inert and provides a light and moisture barrier. The activator portion of the chemiluminescent light composition is usually packaged in such a pouch, although as is well known the oxalate portion may be so-packaged instead. The receptacle is sized to fit the device adjacent the liquid-absorbing article in close proximity to the cavity and holds the volume of liquid which the article must absorb in conjunction with the second liquid component. In preparing the liquid filled receptacle, some nitrogen gas, liquid nitrogen, argon gas, etc. used to flush the receptacle may be trapped therein. In the case of the plastic pouch receptacle, the gas etc. oft-times causes the pouch to assume a pillow shape and thereby assists in releasing the contents upon activation of the device. The second liquid component of the chemiluminescent light composition may be present in the device as such, i.e., as absorbed on the non-woven, liquid-absorbent article or in its own sealed, contents releasable recepticle, as discussed above with regard to the first component. The second component usually comprises the oxalate portion of the chemiluminescent composition although, as is well known, the peroxide portion can be used here instead. Thus, one chemiluminescent composition component may be present in a receptacle or both may be present in individual receptacles. Alternatively, each component may be in its own receptacle and both receptacles be a foil pouch and need not be sealed on all sides. In this configuration, the release of the contents of the receptacles in the pouch, which should be chemically inert, allows initial mixing of the components before contact with the liquid-absorbing article, thereby assuring even greater uniformity of light emmision.

The second, polymeric sheet may be prepared from the same material as the first sheet, but it must be transparent or translucent and it is usually slightly thicker, ranging in thickness from about 0.002 to 0.010 inch. It is also chemically inert, flexible and puncture resistant. A suitable material from which second polymeric sheets are preferably prepared is an ethylene polymer sold by E. I. DuPont de Nemours, Inc. of Wilmington, Del. as 2020T. The second sheet may be die cut, injection molded or thermoformed and, in contrast to the prior art, it need not contain a molded step inside its periphery to reduce bulging of the device caused by pressures resulting from the chemical reaction of the components once activation is effected. The second polymeric sheet may be coated with black ink at the edges or otherwise made opaque outboard of the light emitting area so as to improve cosmetic effect. The peripheries of the first and second polymeric sheets are sealed together to form a non-rupturable bond by heating or ultrasonic sealing, for example, for about 3–10 seconds.

The first, or back, polymeric sheet may have an adhesive area on its outer surface which enables the attachment of the device to a substrate. The adhesive area may be covered with a protective paper layer to protect it from losing its adhesive character, said paper being removable to expose the adhesive.

In a further embodiment, a perforated plastic sheet may be positioned between the non-woven, liquid-absorbing article and the receptacle or receptacles containing the component or components of the chemiluminescent light composition. This plastic sheet acts as a dispenser, its perforations causing the liquid from the ruptured receptacle(s) to be more uniformly dispensed atop the non-woven article and thus aiding in the mixing and the uniform distribution of the composition over the complete area of the article. The perforations in the sheet can range from about 5 to about 500 microns in diameter and the sheet can comprise any inert polymeric material. The dispenser may be added to the device in a disengaged manner or may be heat or sonically sealed to the interior of the device.

When one of the chemiluminescent light components is retained in a rupturable pouch, means may be positioned inside the device to assist in the rupture of the pouch. To this end, a puncturing means such as a spike or spikes may be positioned adjacent the pouch such as by molding said means into the perforated plastic distributing sheet, or into the inside surface of the second opaque polymeric sheet, whereby compression of the device will cause the spike to puncture the pouch. Alternatively, the surface of the pouch may be scored locally so as to promote puncture under compression of the device.

The chemiluminescent light components may be comprised of those chemicals known in the art to create light chemically upon mixing, those disclosed in any of the above specified patents being exemplary. Any such chemicals may be used in the instant device without detracting from the usefulness of the device. A typical yellow chemiluminescent light composition is comprised as follows:

| Oxalate Component | | Activator Component | |
|---|---|---|---|
| Dibutyl Phthalate | 88.6% | Dimethyl Phthalate | 81.40% |
| CPPO (luminescer) | 11.1% | T-butyl alcohol | 13.30% |
| CBPEA (fluorescer) | 0.3% | 90% aq. $H_2O_2$ | 5.29% |
| | | Sodium Salicylate | 0.01 |

CPPO = bis(2,4,5-trichloro-6-carbopentoxyphenyl)oxalate.
CBPEA = 1-chloro-9,10-bis(phenylethynyl)anthracene)

The following examples are set forth for purposes of illustration only and are not to be construed as limitations on the present invention except as set forth in the appended claims. All parts and percentages are by weight unless otherwise specified.

EXAMPLE 1

A device as shown in FIG. 2A is made as follows: A first 2.5"×3" sheet of 0.004" aluminum foil laminate having a heat sealable polyethylene layer thereon is prepared. An area 1.75"×1.75" is located thereon to accommodate a 1.75"×1.75" square of a solid, absorbent, thin lightpiece pad material 0.108" in thickness comprising a porous, flexible polyvinyl chloride produced as in the above-identified pending U.S. patent application. 3.0 Part of the "oxalate component" specified above is absorbed into the pad. A rupturable pouch 1.65"×1.65"×0.135" made from polyethylene/polypropylene/-foil/polyethylene with a seal coating of ethyl methacrylate is charged with 1.0 parts of the "activator component" specified above and hermetically heat sealed around the outside 0.25" periphery thereof. The pouch is placed on the polyethylene-faced side of the piece of laminated sheet. The saturated pad is next placed thereover. A piece of dry open cell polyethylene foam 2.25"×1.25"×0.08" is placed on the polyethylene film-coated back sheet in the open area adjacent the area covered by the saturated pad and the rupturable receptacle. A 2.5"×3" window sheet of transparent low density polyethylene containing a 0.03" pinhole located in the area over the dry pad is placed atop the assembly in peripheral alignment with the first sheet and impulse sealed for 2–4 seconds around the outer 0.125" periphery thereof. Two impulse heat seals 0.125" are next provided on either side of the dry mat to produce an annulus. The first seal is adjacent to and inboard of the top outer seal and runs from sealed edge to sealed edge; the second is 0.125" shorter and does not run to the edge seal opposite the pinhole so as to provide a passageway between the inner compartment and the vent passage. The resultant device does not inflate or distort under pressure or storage. In use, the device is squeezed to cause rupture of the pouch and kneeded to assist in removing all the liquid therefrom. The pad absorbs and retains the entire amount of liquid in the device and is completely saturated thereby almost instantaneously. The components of the chemiluminescent light composition mix thoroughly as evidenced by the uniform yellow light which immediately emits from the outer windowed surface. The pad does not deform when the device is shaken or otherwise used and is opaque as evidenced by the absence of any indication of the ruptured pouch behind the emitted light.

EXAMPLE 2

A device as shown in FIGS. 3A and 3B is prepared following the procedure of Example 1 with the following modifications: The sheets are enlarged, to 3.062"×2.50"; the dry foam pad in the vent passage is enlarged to 2.50"×0.625"×0.08" to cover the areas under the seals to avoid any possibility of a liquid bypass channel. The uppermost heat seal is widened to 0.187" and the adjacent separate seal, which becomes redundant, is eliminated. An additional short heat seal is affixed at a 45° angle to terminate the downstream end of the vent passage. A pressure sensitive adhesive label 1.75"×1.75"×0.06" is affixed to the back side of the back sheet to provide means to stick or mount the device to a substrate; and a peelable overlay is adhesively attached to the front window. This overlay is a foil laminate of 0.004" in thickness and covers and protects the vent and the light emitting window until the device is ready to use. For use, the peelable overlay is removed and the device is kneeded and activated, as described for that of Example 1.

EXAMPLES 3-4

The procedure of Example 1 is followed, except that equivalent size pads of other materials are substituted for that set forth therein. These comprise a chemically inert, non-woven, fibrous polyethylene terephtalate polyester mat sold by American Felt & Filter Co. under the tradename PE 7111, and a glass fiber mat sold by Whatman, Inc., Clifton, N.J., under the tradename 934-AH. Useful devices in accordance with this invention are obtained.

EXAMPLE 5

The procedure of Example 1 is again followed except that the "activator component" is placed in the pad and the "oxalate component" is placed in the contents releasable receptacle. Similar results are achieved.

EXAMPLE 6

Again the procedure of Example 1 is followed, except that a loose film of 0.001 inch thick, opaque, low density polyethylene having a 0.0625" high spike molded into the center thereof is placed between the pad and the pouch. Upon applying pressure, the pouch is quickly and easily ruptured. Similar results are observed.

EXAMPLE 7

A device is prepared from polypropylene sheets having the structure of FIG. 1A. The cavity is filled with a cold mixture of 1.0 parts of the "activator component" specified above and 3.0 parts of the "oxalate component" specified above. The entire device is maintained at freezing temperatures. Any gases generated are released through the pinhole opening without inflating the device. For use, the device is warmed to ambient temperature whereupon the yellow light develops because the the reaction proceeds.

The above-mentioned patents, any applications and/or publications and any test methods are incorporated herein by reference.

Many variations in the present invention will suggest themselves to those skilled in this art in light of the above, detailed description. For example, instead of heat seals, other sealing means can be employed, such as sonically sealing, electron beam sealing, adhesive sealing, and the like. The "oxalate component" can include a fluorescer, such as 9,10-bisphenylethynylanthracene; 1-chloro-9,10-bis phenylethynylanthracene and 2-chloro-9,10-bis(paramethoxyphenyl)anthracene, e.g., a green fluorescer, so that the device glows green instead of yellow. Instead of a bis(substituted-phenyl)oxalate, the chemiluminescent compound can be selected from 3-aminophthalhydrazide; 2,4,5-triphenylimidazole; 10,10'-dialkyl-9,9'-biacridinium salts; 9-chlorocarbonyl-10-methylacridinium chloride; and the like. Instead of a dialkyl phthalate, the solvent for the two part compositions can comprise ethylene glycol ethers, citric acid esters and alkyl benzoates, and the like. All such obvious modifications are within the full intended scope of the appended claims.

We claim:

1. A flexible, thin, chemiluminescent device comprised of (i) a back sheet of a polymer or a polymer-laminated metal foil;

(ii) a front sheet comprising a transparent or translucent polymer heat sealed at its edges to said back sheet to provide a fluid-tight internal cavity for a two-component chemiluminescent system;

(iii) separation means positioned so as to divide the internal cavity of said device into two compartments, one larger and one smaller;

(iv) a contents-releasable, fluid-tight receptacle containing a solvent solution of a first chemical component within said larger compartment;

(v) an absorbent material containing a solvent solution of a second chemical component within said larger compartment but external to said receptacle;

(vi) an open passageway between said larger and said smaller compartments; and (vii) a vent in the wall of said smaller compartment and located downstream from said passageway, whereby deformation of the larger compartment causes release of the contents of the receptacle and mixes the chemical components for absorption by the liquid-absorbent material therein to react and produce light, any gases generated during storage or the light-producing reaction passing into said smaller compartment and being released therefrom through said vent instead of distorting or inflating the device.

2. The device according to claim 1 wherein said separation means comprises a linear heat seal inboard of the sealed edges.

3. The device according to claim 2 wherein said linear heat seal extends substantially completely around the periphery of said device inboard of the sealed edges so as to provide said smaller compartment in the form of a relatively long annulus.

4. The device according to claim 1 wherein said smaller compartment contains an oliophobic material to prevent or retard passage of liquid components while allowing gaseous products to escape through the vent.

5. A device according to claim 4 wherein said liquid-absorbant material comprises open-celled foamed polyethylene.

6. A device according to claim 1 having a self-adhering surface on the outside of said back sheet.

7. A device according to claim 1 wherein said vent is in said transparent or translucent front sheet (ii) and which includes a peelable overlay over said front sheet (ii).

8. A device according to claim 4 wherein said oliophobic material is sealed to said smaller compartment edges.

* * * * *